United States Patent [19]

Butler

[11] Patent Number: 4,702,136

[45] Date of Patent: Oct. 27, 1987

[54] TOOL HOLDER FOR WIRE CUTTER

[75] Inventor: John D. Butler, New Berlin, Wis.

[73] Assignee: Mechtrix Corporation, Wauwatosa, Wis.

[21] Appl. No.: 865,686

[22] Filed: May 22, 1986

[51] Int. Cl.[4] ..... B21F 11/00

[52] U.S. Cl. ..... 83/694; 83/697; 83/698; 83/700; 83/623; 81/9.51; 140/140

[58] Field of Search ..... 83/694, 697, 698, 700, 83/623; 140/140, 139, 123.6; 81/9.51

[56] References Cited

U.S. PATENT DOCUMENTS

| | | | |
|---|---|---|---|
| 483,095 | 9/1892 | Barrow | 83/698 |
| 2,336,662 | 12/1943 | Wintress | 83/694 X |
| 3,122,048 | 2/1964 | Warner | 83/700 X |
| 3,309,948 | 3/1967 | Falken | 81/9.51 |
| 3,527,124 | 9/1970 | Ullman | 81/9.51 |
| 3,857,306 | 12/1974 | Gundmestad | 81/9.51 |
| 3,913,426 | 10/1975 | Blaha | 81/9.51 |
| 4,109,555 | 8/1978 | Borzym | 83/700 X |
| 4,317,391 | 3/1982 | Gundmestad | 81/9.51 |

*Primary Examiner*—Donald R. Schran
*Attorney, Agent, or Firm*—Fuller, Puerner & Hohenfeldt

[57] ABSTRACT

The tool holder of a machine for cutting a supply of insulated electrical conductor into discrete lengths employs a standard cutting blade. The standard blade serves as the outer boundary of the tool holder and of the remainder of the machine, thereby assuring that the cut lengths can pass to the next processing station without striking any component and thereby become disoriented. Use of the standard cutting blades is accomplished by employing conventional fasteners to retain the blade on the tool holder. The cutting blade is located in the tool holder by a slotted member and blade shank end locator.

5 Claims, 12 Drawing Figures

TOOL HOLDER FOR WIRE CUTTER

BACKGROUND OF THE INVENTION

1. Field of the Invention.

This invention pertains to tool holders, and more particularly to holders for tools employed to cut insulated electrical conductors.

2. Background of the Invention.

Various equipment has been designed to process individual pieces of insulated electrical conductor cut from an endless supply thereof. Examples of such equipment are discussed in U.S. Pat. Nos. 3,309,948; 3,527,124; 3,857,306; and 3,913,426. U.S. Pat. No. 4,317,391 shows an insulated conductor cutting and stripping machine wherein the cutting blades are secured to reciprocating slides by means of blade clamps. The cutting blades are positionable longitudinally with respect to the conductor to be cut by a dovetail arrangement.

A well-known machine for cutting a supply of conductor into relatively short lengths is the Model CS-9AT machine manufactured by Artos Engineering Company of New Berlin, Wis. Referring to FIG. 1 of the drawings, that machine is depicted schematically at reference numeral 1. Reference numeral 3 indicates a reel that holds a very long length of conductor 5. The conductor 5 from the reel 3 is fed horizontally in the direction of arrow 7 by a suitable mechanism, not shown. Reference numeral 9 indicates schematically a pair of substantially identical tool holders. The tool holders 9 reciprocate horizontally, as indicated by arrow 45, such that cutting blades 11 and 13 cooperate to sever the endless conductor into shorter pieces 15 of desired length, as is known. The severed pieces of conductor 15 are secured by clamps 18 onto a double track conveyor 17 that transports the pieces to other stations for further processing. The direction of conveyor 17, as indicated by arrow 19, is perpendicular to the direction 7 of the wire.

An important consideration in the design of an insulated conductor cutting machine is that the cut pieces 15 must be free to move unobstruced past the tool holders 9 onto the conveyor 17 as it is indexed. Specifically, it is essential that the trailing ends 33 of the pieces 15 do not strike any portion of the machine 1, including the tool holders, because that would cause the cut pieces to skew on the conveyor and cause problems at downstream processing stations. Accordingly, it is known to place the blades 11 and 13 at the extreme ends of the tool holders. Referring to FIG. 2, the construction of a conventional tool holder is shown in detail. The cutting blades 11 and 13 form the outer boundaries of the tool holders and machine, and they also define the boundary of the path of the cut piece 15 through the machine.

Each tool holder 9 includes a bracket 21 that is mounted for reciprocation on the machine by well-known means. The bracket 21 is manufactured with a pair of opposed faces 23. Between the faces 23 are inserted a number of spacers 25 and a leg 27 of a blade holder 29. The required placement of the blade 13 results in a blade holder 29 designed with a generally Z-shape. The spacers 25 and blade holder 29 are held firmly in place by set screws 31. The longitudinal position of the blade 13 is adjustable by interchanging the leg 27 with any of the spacers. The blade 13 is secured to the outer leg 35 of the blade holder by one or more screws 37 that are threaded into tapped holes 39 of the blade 13. Thus, the blade 13 forms the outer boundary of any portion of the machine that could lie within the path of the ends 33 of the cut pieces 15.

Although the prior tool holder 9 has had some commercial success, it nevertheless has several deficiencies. One shortcoming is that it is very expensive to provide a cutting blade with the tapped holes 39. A cutting blade with the tapped holes costs about four times that of the identical blade without the tapped holes. Another disadvantage of the design of FIG. 2 is that the spacers 25 must be rearranged in relation to the leg 27 when it is necessary to change the location of the blade along the path of the wire 5. That requires the entire tool holder to be removed from the bracket for repositioning the cutting blade. Such manipulations of the cumbersome spacers and blade holder results in expensive and inconvenient machine down-time. Further, the discrete lengths of the spacers impose steps that limit the number of locations at which the blade holder can be positioned.

As mentioned, the insulated conductor cutting machine 1 must be designed such that no part of the machine is in the path of the cut pieces, particularly trailing ends 33. Neither the tool holder nor the machine described in U.S. Pat. No. 4,317,391 meet those criteria.

Thus, a need exists for a tool holder for an insulated conductor cutting machine that employs standard cutting blades and eliminates the positioning limitations of prior tool holders.

SUMMARY OF THE INVENTION

In accordance with the present invention, a cut-off tool holder is provided that enables a standard cutting blade to cut an endless insulated electrical conductor into pieces of selected lengths without causing the pieces to strike the tool holder or supporting machine as the cut lengths are transported past the cutting blades. This is accomplished by apparatus that includes a pair of clamps that firmly hold the shank end of the cutting blade to a longitudinally adjustable blade support.

The tool holder is comprised of a base that is mounted for reciprocation within a conductor cutting machine. The base is longitudinally grooved to slidingly receive an adjusting bar. The adjusting bar is of a generally L-shaped configuration. One end of the adjusting bar is clampable to the base at any desired location thereon. The first face of the cutting blade is located against and directly mounted to the end face of the second end of the adjusting bar.

The second end of the adjusting bar is formed with a head portion that is slotted to receive the shank end of the cutting blade. The shank edge of the cutting blade is located against a pin pressed into the head slot. The cutting blade is retained within the head slot on the adjusting bar head by a pair of conventional fasteners, such as button-head cap screws that serve as the clamping means for securing the cutting blades.

The cutting blade forms the outer boundary of the tool holder of the present invention. The fasteners are not in the way of the cut lengths of conductor. Thus, no part of the tool holder or cutting machine obstructs the transportation of the cut piece to other parts of the processing machinery. The fasteners holding the cutting blades are accessible from the exterior of the tool holder. Consequently, blade changing is a simple and speedy task, being accomplished merely by loosening the fasteners, exchanging blades, and retightening the fasteners. Similarly, longitudinal adjustment of the cutting blades is accomplished merely by unclamping the adjusting bar from the base, positioning the adjusting bar to any desired location, and reclamping the adjusting bar to the base.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
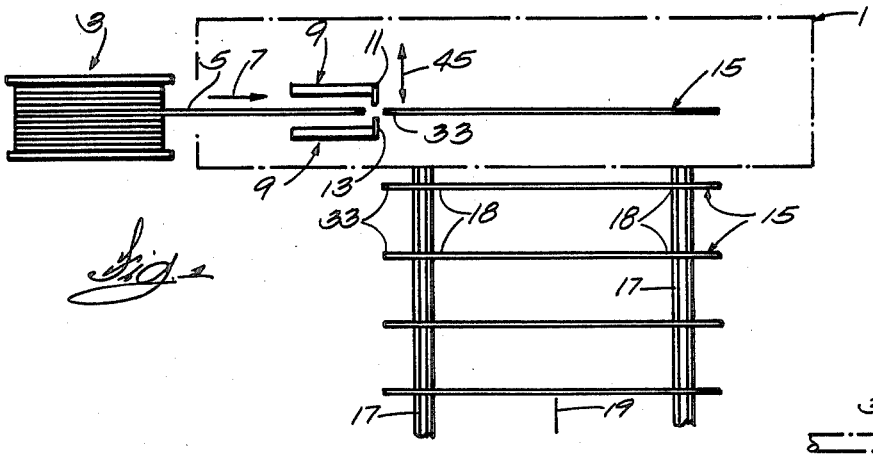
FIG. 1 is a schematic top view of a machine for cutting lengths of insulated electrical conductors from a supply thereof.

Referring to FIGS. 3–6, reference numeral 41 indicates the tool holder of the present invention. The tool holder 41 is particularly useful when used in pairs in connection with an insulated conductor cutting machine 1, FIG. 1, for cutting long lengths of insulated electrical conductors into shorter lengths. However, it will be understood that the invention is not limited to electrical applications.

The tool holder 41 is comprised of a base 43 that is mounted for reciprocation within the conductor cutting machine 1. The base 43 is mounted to known reciprocating mechanisms within the machine by conventional means, not shown. The direction of reciprocation is indicated by arrow 45. The base is fabricated with a longitudinal groove 47 in which is slidingly received the first end 48 of an adjusting bar 49. The central portion of the adjusting bar has a longitudinal slot 51, through which pass a pair of screws 53 that thread into tapped holes 55 in the base. Preferably, washers 57 and lock washers 58 are used in conjunction with the screws 55.

Figure 2:
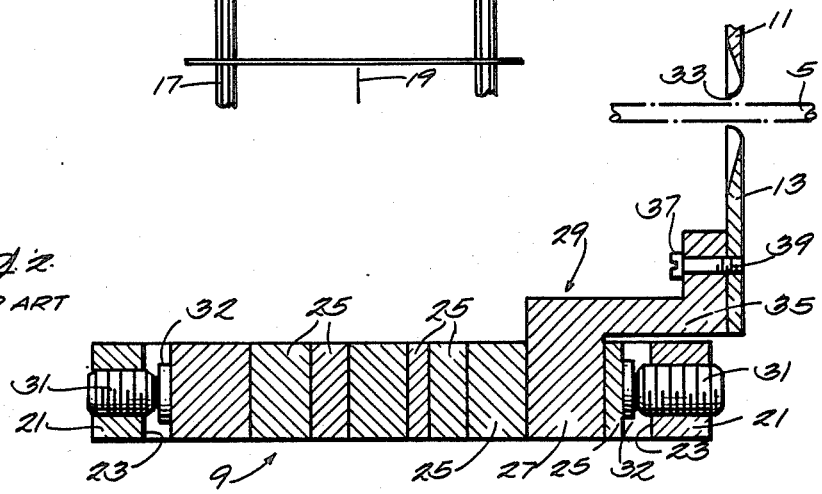
Fig. 2 PRIOR ART
FIG. 2 is a top view of a prior art tool holder employed with the machine of FIG. 1 for cutting lengths of insulated conductors.
Figure 6:
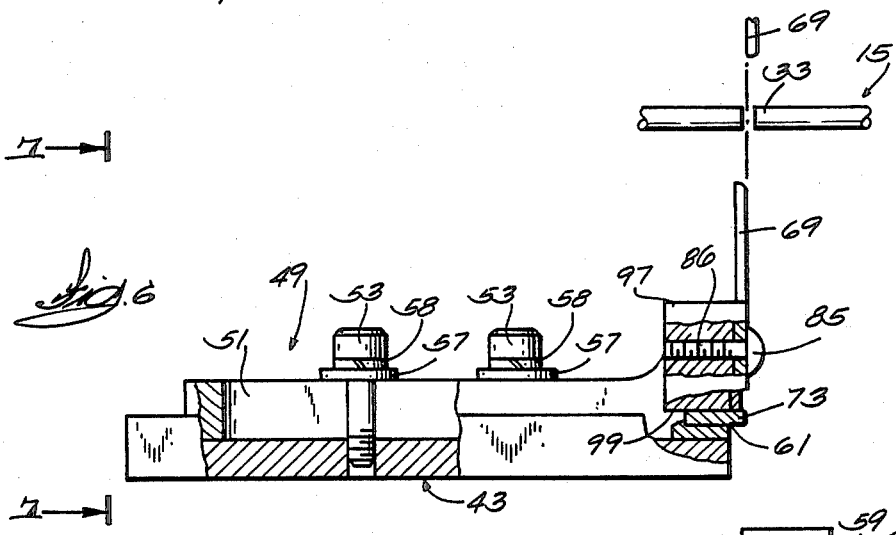
FIG. 6 is a top view, partly in section, taken along lines 6—6 of FIG. 5 and rotated counterclockwise 90 degrees.
Figure 11:
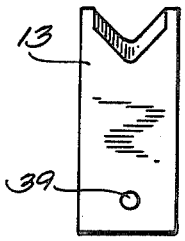
FIG. 11 is a view of a prior art cutting blade.
Figure 12:
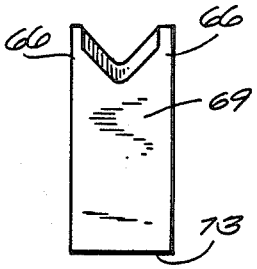
FIG. 12 is a view of a conventional cutting blade used in conjunction with the present invention.

Pursuant to the present invention, a standard insulated conductor cutting blade 69 is used with the tool holder 41, and the cutting blade 69 requires no special threaded hole 39 such as the prior art blade 13 shown in FIGS. 2 and 11 to adapt it to the instant tool holder. The construction of standard cutting blades is well known to persons familiar with the art of cutting insulated electrical conductors. The two conventional cutting blade types are shown in FIGS. 11 and 12. The blade of FIG. 11 requires an additional threaded hole 39 to locate it in the prior art tool holder. Since the hole must be tapped with the blade in the non-heat treated state, there are additional finish machining operations required on the width and thickness surfaces of the cutting blade after heat treating the blade to the required hardness necessary for proper blade life. It will be clear to those skilled in the art that the conventional type cutting blade 69 of FIG. 12 is less costly to manufacture and is more efficiently manufactured in a production environment than the conventional cutting blades of FIGS. 2 and 11. It is therefore significant that the present invention can facilitate the use of the cutting blade 69 of FIG. 12, allowing significant savings to the user because of the lesser cost of the perishable cutting blade design without the threaded hole.

The adjusting bar 49 is manufactured with a head or blade support end 59 that projects in three directions from the second end of the adjusting bar 49. The head 59 includes a pair of pedestals 97 that extend symmetrically vertically from the head 59. The pedestals 97 also extend horizontally toward the front of the tool holder 41, that is, downward with respect to FIG. 8. The backsides 99 of the pedestals terminate forwardly of the base 43, thus allowing a full range of longitudinal positioning of the blade support end 59 with respect to the base.

Figure 8:
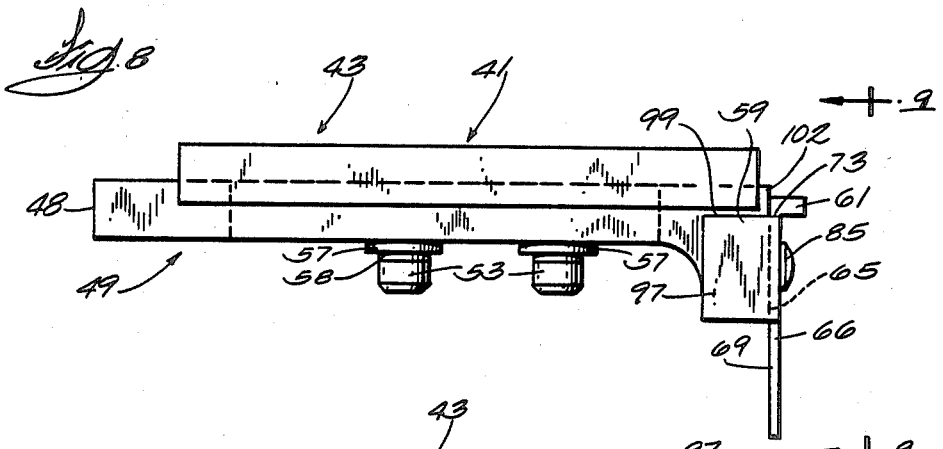
FIG. 8 is a top view of the present invention.
Figure 10:
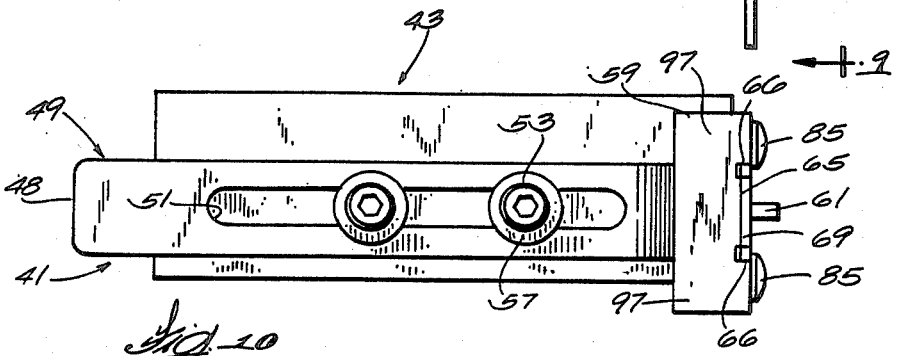
FIG. 10 is a front view of the present invention.

To accurately and rigidly hold a standard cutting blade 69 in the tool holder 41, the head 59 is formed with a horizontal slot 65 that has a width sized to closely guide the longitudinal edges 66 of the cutting blade. The depth of the slot is slightly less than the thickness of the cutting blade. The bottom surface of the slot 65 is coplanar with the head edge surface 102 of the bar 49, as best shown in FIG. 8. Thus, the pedestals 97 overhang the edge surface 102, as is best shown in FIGS. 8 and 10.

Figure 5:
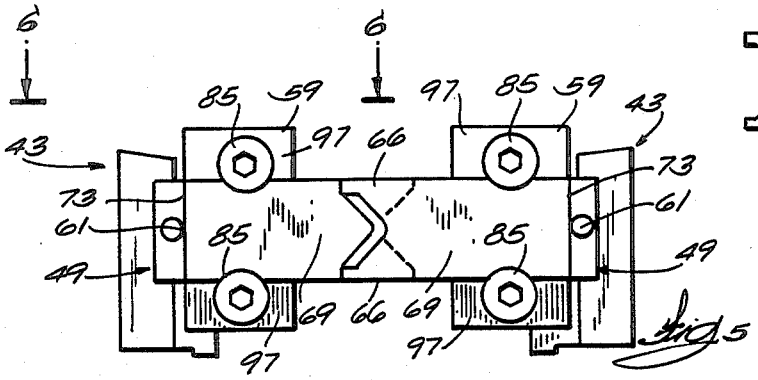
FIG. 5 is an end view of a pair of the tool holders according to the present invention in operational relationship to cut an insulated conductor.
Figure 7:
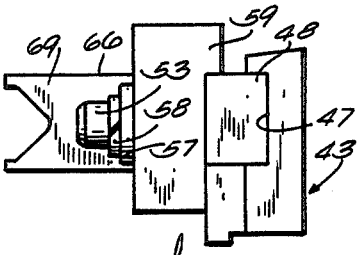
FIG. 7 is a view taken along lines 7—7 of FIG. 6 and rotated counterclockwise 90 degrees.
Figure 9:
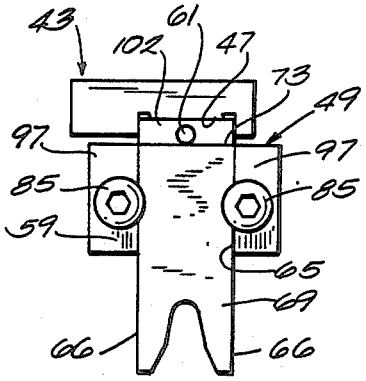
FIG. 9 is a view taken along lines 9—9 of FIG. 8.

To locate the shank edge 73 of the cutting blade 69, a dowel pin 61 is press-fit into the head end surface 102 of the blade support end 59. To retain the cutting blade within the blade holder, a large headed fastener 85 is screwed into an appropriate tapped hole in each pedestal 97 such that the heads overlap the shank longitudinal edges 66 of the cutting blade as best shown in FIGS. 5 and 9. The fasteners 85 may be conventional button-head cap screws. When located by the slot 65 and pin 61 and retained by the fasteners 85, the cutting blade is capable of precisely cutting insulated electrical conductors on a continuous basis without interfering with the movement of the cut piece ends 33 as they are transported from the tool holder 41 to other portions of the cutting and stripping machine.

Changing a cutting blade 69 is a simple matter. The screws or fasteners 85 are merely loosened slightly, and the old blade is removed. After a new blade has been positioned within the slot 65 and located against pin 61, the fasteners 85 are retightened.

Figures 3, 4:
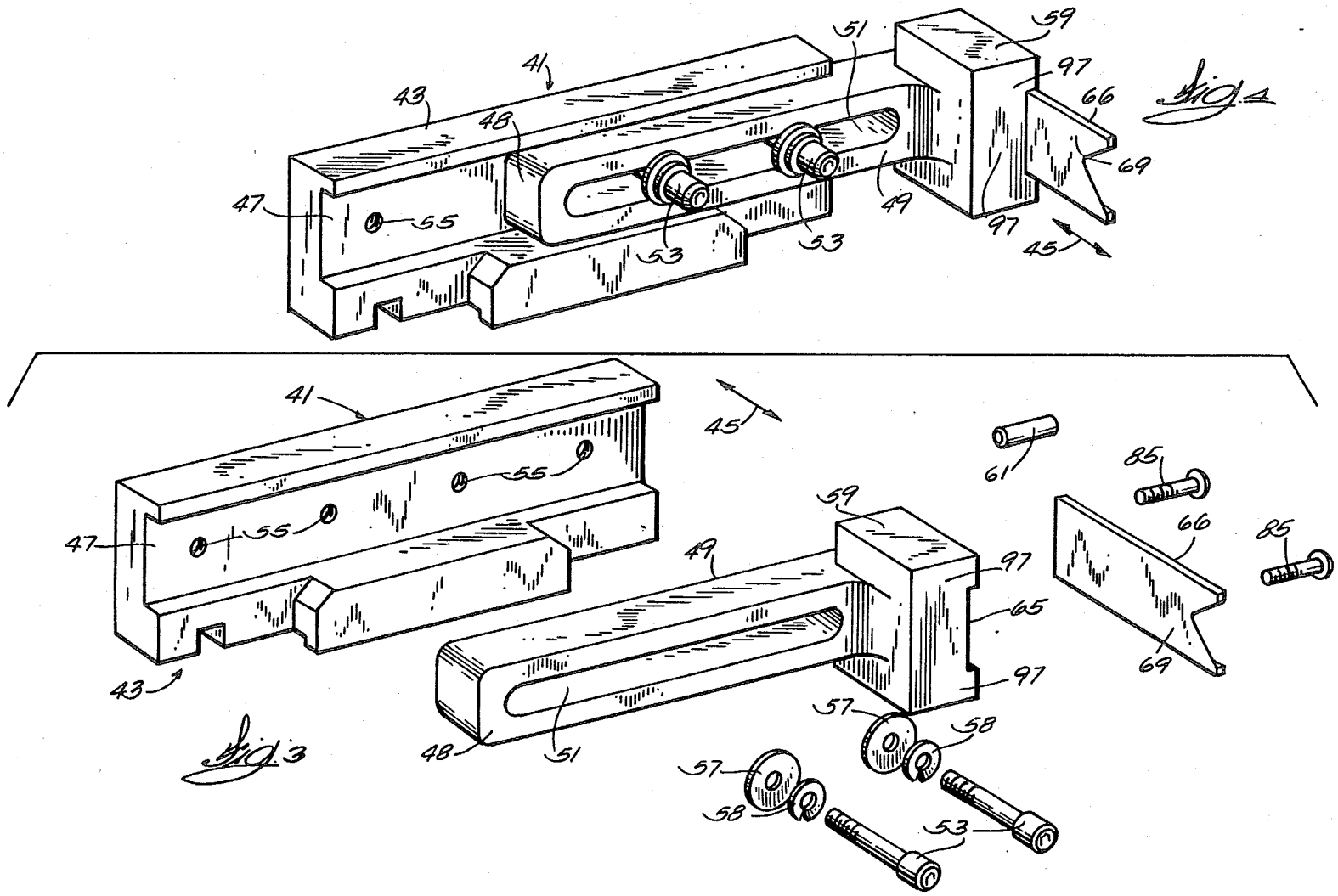
FIG. 3 is an exploded perspective view of the components comprising the tool holder of the present invention.
FIG. 4 is a perspective view of the tool holder of the present invention in the assembled condition.

Changing the position of the wire ends 33 with respect to the conveyor clamps 18 is also a simple matter. Often, due to wire stretching, the position of ends 33 must be varied on the cutting and stripping machine of FIG. 1 to facilitate proper location of the wire ends in the equipment located downline on the conveyors 17. An example of such equipment would include a press for crimping a terminal on the stripped end of the wire. To make such a change with the present invention, screws 53 are merely loosened slightly, and the adjusting bar 49 is slid within the groove 47 of the base 43, as best shown in FIG. 4. Once accurately positioned, the screws 53 are retightened. In contrast, the prior art tool holder 9 of FIG. 2 has to be entirely removed from machine 1 of FIG. 1 in order to make a wire end 33 positional change. That is an extremely cumbersome task since the leg 27 must be removed from the tool holder bracket 21 and repositioned via repositioning the various spacers 25, as best shown in FIG. 2.

Thus, it is apparent that there has been provided, in accordance with the invention, a tool holder for a wire stripper that fully satisfies the objects, aims, and advantages set forth above. While the invention has been described in conjunction with specific embodiments thereof, it is evident that many alternatives, modifications, and variations will be apparent to those skilled in the art in light of the foregoing disclosure. Accordingly, it is intended to embrace all such alternatives, modifications and variations as fall within the spirit and broad scope of the appended claims.

I claim:

1. In a machine for cutting a supply of elongated insulated electrical conductor into selected lengths, a pair of oppositely reciprocating tool holders adapted to cooperate to cut the insulated conductor, each tool holder comprising:

(a) base means for reciprocating within the machine;

(b) adjusting bar means mounted to the base means for stepless adjustable positioning along substantial distances relative thereto in a direction substantially parallel to the elongated insulated conductor;

(c) an imperforate cutting blade having first and second opposed faces, opposed longitudinal edges, and an end edge;

(d) blade support means integral with the adjusting bar for guiding the first face, longitudinal edges and end edge of the cutting blade to locate the cutting blade in a plane substantially perpendicular to the direction of the insulated conductor and at a location at which the cutting blade second face forms the outer boundary of the tool holder and machine to thereby permit the cut lengths of insulated conductor to pass unobstructed from the tool holder and machine; and (e) clamp means for releasably retaining the cutting blade on the blade support means, so that a standard imperforate cutting blade can be employed to form the outer boundary of the tool holder and machine.

2. Apparatus for cutting selected lengths of insulated electrical conductors from a supply thereof comprising:

(a) a base formed with a longitudinal groove extending substantially parallel to the insulated electrical conductor to be cut;

(b) an imperforate cutting blade having two opposed faces, two opposed longitudinal edges, and a shank edge;

(c) a blade holder mounted to the base and having a bar portion adapted to slide within the base groove and to be releasably fastened to the base at selected locations therealong, the blade holder being formed with a head having a pair of pedestals extending laterally from one end of the bar portion, the pedestals defining a slot for locating one face and the opposed longitudinal edges of the cutting blade such that the cutting blade second face forms the outer boundary of the insulated electrical conductor cutting apparatus;

(d) locating means mounted to the blade holder for locating the cutting blade shank edge; and (e) clamp means for retaining the cutting blade to the blade holder, the clamp means comprising a fastener received in each pedestal and having an enlarged head for overlapping the cutting blade to thereby retain the cutting blade in the blade holder slot.

3. In a machine for cutting a supply of elongated insulated electrical conductor into selected lengths, a pair of oppositely reciprocating tool holders adapted to cooperate to cut the insulated conductor, each tool holder comprising:

(a) base means for reciprocating within the machine;

(b) an imperforate cutting blade having first and second opposed faces, opposed longitudinal edges, and a shank edge;

(c) blade holder means mounted to the base means for stepless adjustable positioning relative thereto over a substantial distance in a direction substantially parallel to the elongated insulated conductor, the blade holder means being adapted to locate the cutting blade in a plane substantially perpendicular to the direction of the insulated conductor and at a location at which the cutting blade second face forms the outer boundary of the tool holder and machine to thereby permit the cut lengths of insulated conductor to pass unobstructed from the cutting blade; and (d) clamp means for releasably retaining the cutting blade on the blade support means, so that a standard cutting blade can be employed to form the outer boundary of the tool holder and machine.

4. The tool holder of claim 3 wherein the blade holder means comprises:

(a) a blade holder having an elongated bar portion terminating in an end surface and a head extending laterally from the bar portion adjacent the end surface to create an L-shaped structure, the head defining a slot for locating the longitudinal edges of the cutting blade; and (b) a pin pressed into the bar portion end surface for locating the cutting blade shank edge.

5. Apparatus for cutting selected lengths of insulated electrical conductors from a supply thereof comprising:

(a) a base formed with an elongated longitudinal groove extending substantially parallel to the insulated electrical conductors to be cut;

(b) an imperforate cutting blade having two opposed faces, two opposed longitudinal edges, and a shank edge;

(c) an adjusting bar having an elongated first end adapted to slide for substantial distances within the base groove and to be releasably fastened to the base at selected locations therealong and a second end defining an edge surface;

(d) a blade support joined integrally with the adjusting bar at the second end thereof, the blade support comprising a pair of pedestals that extend orthagonally in two directions from the adjusting bar to cooperate therewith to create a generally L-shaped structure, the pedestals being configured to provide adequate support for the cutting blade at substantial distances from the adjusting bar and to allow a full range of longitudinal positioning of the blade support relative to the base, the pedestals defining a slot for locating the cutting blade such that the cutting blade defines the outer boundary of the cutting apparatus;

(e) a pin extending from the adjusting bar second end for locating the cutting blade shank edge; and (f) clamping means secured to pedestals for bearing against the cutting blade second face to thereby retain the cutting blade on the blade support.

* * * * *